United States Patent [19]

Hampton

[11] 4,009,898

[45] Mar. 1, 1977

[54] DRUM LIFTING ATTACHMENT

[76] Inventor: Harvie G. Hampton, 1863 S. Brookwood Drive, Shreveport, La. 71108

[22] Filed: Oct. 2, 1975

[21] Appl. No.: 618,821

[52] U.S. Cl. ..... 294/31.2; 294/90

[51] Int. Cl.[2] ..... B66C 1/18

[58] Field of Search ..... 294/31.2, 67 BA, 67 D, 294/74, 90, 91; 24/270, 271; 214/650 R, 651; 224/45 A, 45 C

[56] References Cited

UNITED STATES PATENTS

| | | | |
|---|---|---|---|
| 625,573 | 5/1899 | Leavitt | 294/31.2 X |
| 1,332,234 | 3/1920 | Raidt | 294/74 |
| 2,740,655 | 4/1956 | Maly | 294/31.2 |
| 2,775,806 | 1/1957 | Love | 24/271 |
| 2,831,720 | 4/1958 | Renfroe | 294/31.2 |
| 3,212,469 | 10/1965 | Kershaw et al. | 294/81 R X |
| 3,240,407 | 3/1966 | Boak | 294/31.2 X |

*Primary Examiner*—Johnny D. Cherry
*Attorney, Agent, or Firm*—John M. Harrison

[57] ABSTRACT

A lifting attachment for lifting and maneuvering drums, and 55 gallon drums in particular, which includes a drum collar adapted to fit around the circumference beneath the top rim of a drum, and a plurality of lift straps attached to the collar with a lift ring at the top of the coincidence of the straps. The collar is fitted with a clamp for tightening the collar securely around the drum body.

2 Claims, 6 Drawing Figures

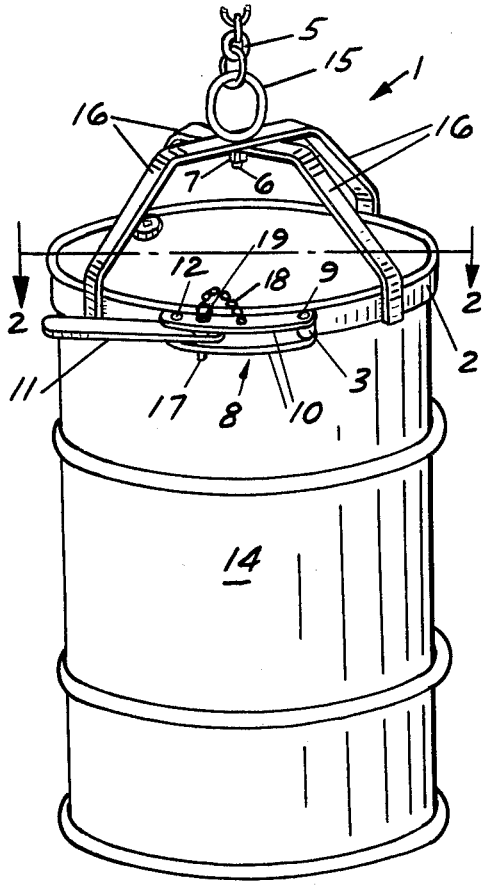
FIG. 1
FIG. 2
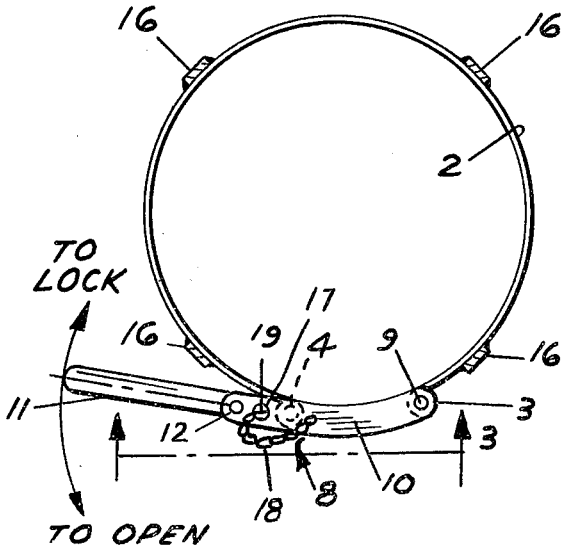
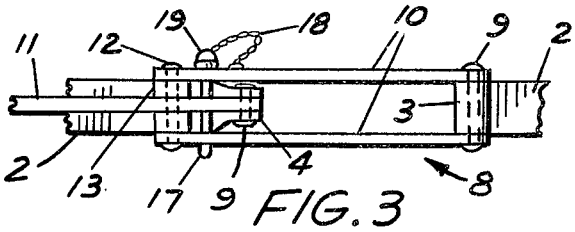
FIG. 3
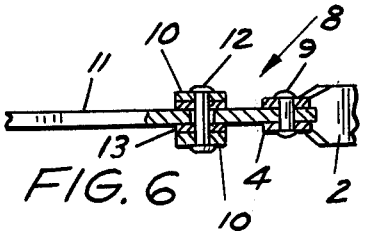
FIG. 6
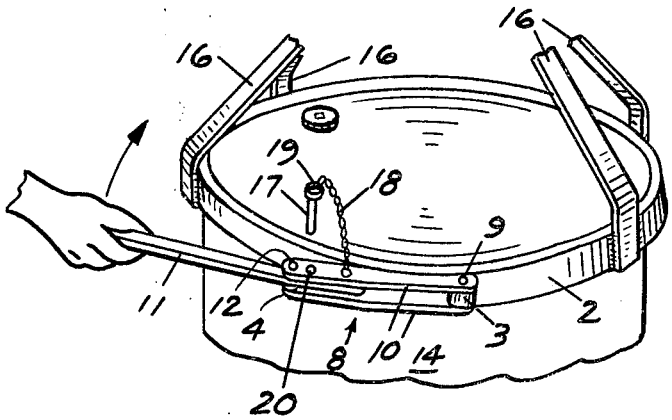
FIG. 5
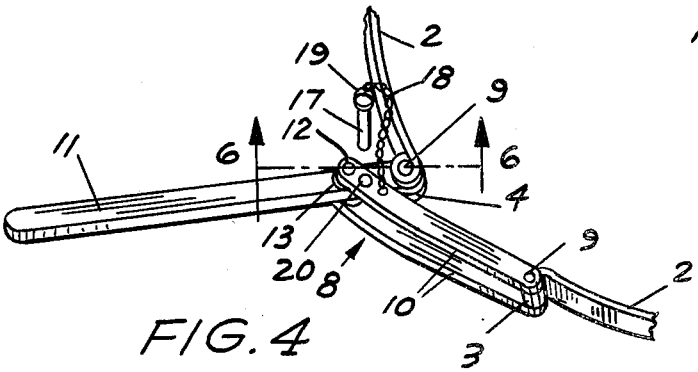
FIG. 4

DRUM LIFTING ATTACHMENT

BACKGROUND OF THE INVENTION

1. Field of the Invention

This invention relates to the relocation, handling and storage of drums containing liquid chemicals of various description, and particularly, to a drum lifting attachment which is adapted to clamp on one end of a drum beneath the drum rim to provide a means for lifting and handling the drum. The device can be quickly and easily clamped onto a typical 55 gallon drum and subsequently disengaged and used on another drum after the first drum is moved without disengaging the lift cable or hoist hook from the lifting attachment. Furthermore, since most drums are shipped and stored in an upright position, the drum lifting attachment of this invention is particularly useful and efficient, since it attaches to one end of the drum and enables movement of the drum while the drum is maintained in an upright position at all times.

2. Description of the Prior Art

Heretofore, various mechanisms have been devised for lifting and transporting drums, and 55 gallon drums in particular. Many of these devices have been designed for use with forklift vehicles, such as the device described in U.S. Pat. No. 2,689,663 to L. C. Shramek. This lifter consists of a hooked member designed to cooperate with the lifting forks of a forklift vehicle to lift drums. The hooked member is designed to engage one of the rims of a drum to secure the drum, and lifting is effected from this point. Two distinct disadvantages of such an apparatus are apparent in the initial difficulty of maneuvering the forklift truck carefully into a precisely correct position with respect to the drum in order to engage the hook and lift the drum, all without damaging the drum, and subsequently transporting the drum safely without bouncing or vibrating it out of the grip of the hooked member.

Another drum lifting device is disclosed in U.S. Pat. No. 2,760,662 to E. R. Kughler. This device is also used in connection with a fork truck, and is adapted to grip the rims of a pair of drums simultaneously while the drums are disposed in a horizontal position. Lifting and transportation are achieved with the drums in the horizontal position. As heretofore discussed, a chief disadvantage of this technique lies in the difficulty of maneuvering the forklift truck into position to achieve a reliable lift without damage to the drums. Another problem results from changing the drums from the horizontal position to a vertical stored position without risking drum damage with possible leakage and spillage of the contents.

Similar lifting apparatus are disclosed in U.S. Pat. No. 2,827,184 to J. J. Mueller and U.S. Pat. No. 3,175,719 to E. C. Herndon, both of which are designed to be used in cooperation with a forklift truck or similar vehicle.

As heretofore noted, prior art drum lifting, handling and relocation devices are all subject to the disadvantage of requiring precise maneuvering of a forklift vehicle into a particular area in order for the specific lifting device to be engaged and the drum or drums lifted and moved. Furthermore, many of the devices are characterized by sharp projections necessary to engage the rims or other areas of the drums, which projections can puncture or at least weaken the drums, and sometimes cause dangerous chemical leakage.

Accordingly, an object of this invention is to provide a drum lifting attachment for lifting and moving drums while the drums remain in an upright position.

Another object of the invention is to provide an apparatus for lifting drums which can be releasably fastened to substantially any conventional lifting device and to the drum to be lifted.

Yet another object of the invention is to provide a drum lifting attachment which is designed to removably clamp around one end of a drum under the drum rim to securely grip the drum with maximum safety during the lifting and handling operation.

A still further object of the invention is to provide a drum lifting device which can be removably attached to substantially any lifting boom, overhead crane or fork truck and successively, quickly, and easily attached to a supply of drums positioned in the upright position to move the drums from one place to another.

Yet another object of the invention is to provide a drum lifting attachment equipped with a quick-release coupling so that the attachment may be quickly and easily released from the relocated drum and coupled to another drum to be moved.

SUMMARY OF THE INVENTION

These and other objects of the invention are provided in a drum lifting attachment adapted to removably lock to and enable lifting of a drum, which includes the following elements:

1. A collar adapted to substantially encircle the drum;
2. At least one collar lift strap attached to the collar and having a lift ring mounted at the coincidence of the straps; and
3. A quick-release clamp mounted in cooperation with the collar for clamping the collar securely to the drum.

BRIEF DESCRIPTION OF THE DRAWINGS

The invention will be better understood in view of the following description presented with reference to the accompanying drawing:

FIG. 1 of the drawing is a perspective view of the drum lifting attachment of this invention secured in locked position on a typical drum;

FIG. 2 is a top elevation, partially in section, of the drum lifting attachment taken along lines 2—2 in FIG. 1;

FIG. 3 is a front elevation, partially in section, and taken along lines 3—3 in FIG. 2, of the quick-release clamp designed to selectively tighten and release the drum lifting attachment illustrated in FIGS. 1 and 2;

FIG. 4 is a perspective view, partially in section, of the quick-release clamp illustrated in FIG. 3, in released position;

FIG. 5 is a perspective view, partially in section, of the drum lifting attachment illustrated in FIG. 1, more particularly illustrating the quick-release clamp being moved into the locked position on a drum; and FIG. 6 is a front elevation of the clamp, partially in section, taken along lines 6—6 in FIG. 4, more particularly illustrating the pinning of the clamp members.

DESCRIPTION OF THE PREFERRED EMBODIMENTS

Referring now to FIGS. 1-3 of the drawing, the drum lifting attachment of this invention, generally illustrated by reference numeral 1 is disclosed, with drum collar 2, adapted to encircle most of the circumference of drum 14, the ends of which drum collar are formed into first and second drum collar flanges 3 and 4, respectively. Quick-release clamp 8 spans the distance between, and is pivotally joined to drum collar flange 3 and 4 by means of flange pins 9. Referring now to FIGS. 3 and 4 of the drawing, clamp lock plates 10 are mounted in essentially parallel relationship to each other and are joined to first drum collar flange 3 of drum collar 2 at one end thereof by means of a flange pin 9. The opposite ends of clamp lock plates 10 are joined by means of clamp lock plate pin 12 to clamp lever 11 at a short distance from one end of clamp lever 11. This end of clamp lever 11 is in turn pinned to second drum collar flange 4 by means of a flange pin 9. Clamp lever 11 and second drum collar flange 4 extend into the bifurcation created by parallel clamp lock plates 10 when quick-release clamp 8 is in the locked position, as shown in FIGS. 3 and 5. As further illustrated in FIGS. 3 and 6, second drum collar flange 4 may be reduced in thickness before being pinned in order to insure that the flange-pin combination will easily fit into the bifurcated area upon locking of quick-release clamp 8. Optional safety pin 17 is provided to securely lock quick-release clamp 8 into locked position if desired; a safety pin aperture 20 is provided in clamp lock plates 10 and in clamp lever 11, which apertures register when quick-release clamp 8 is locked. Safety pin 17 is then slipped into registration with the apertures, and safety pin chain 18, in cooperation with chain retainer 19, serve to prevent safety pin 17 from being lost when it is removed and quick-release clamp 8 is opened.

Cooperation between quick-release clamp 8 and drum collar 2 to selectively secure and release drum collar 2 to and from drum 14 is illustrated in FIGS. 4–6 of the drawing. Manipulation of clamp lever 11 causes it and clamp lock plates 10 to pivot on clamp lock plate pin 12 and on flange pins 9 to lock and release quick-release clamp 8, as illustrated. Movement of clamp lever 11 toward drum 14 in the direction of the arrow as illustrated in FIGS. 2 and 5 of the drawing locks quick-release clamp and secures drum collar 2 on drum 14, while manipulation of the lever away from the drum as illustrated in FIGS. 2 and 4 releases the clamp and loosens drum collar 2. When quick-release clamp 8 is in locked position as illustrated in FIGS. 1, 2 and 5 of the drawing, the end of clamp lever 11 pivoted to drum collar flange 4 and the flange itself are positioned inside the bifurcation created by parallel mounted clamp lock plates 10, as heretofore noted. Furthermore, the pivot point created by pinning clamp lever 11 to clamp lock plates 10 by means of clamp lock plate pin 12 is located behind a line connecting first drum collar flange 3 and second drum collar flange 4 to secure clamp lever 11 in locked position. This locking action causes first and second drum collar flanges 3 and 4 to move toward each other because of the levering action of clamp lever 11 and clamp lock plates 10 to tighten drum collar 2 securely on drum 14. Manipulation of clamp lever 11 away from drum 14 disengages quick-release clamp 8 and allows drum collar flanges 3 and 4 to move away from each other, thereby loosening the grip of drum collar 2 on drum 14, and permitting removal of the drum lifting attachment 1 from drum 14. As illustrated in FIG. 6, a clamp lock plate bushing 13 can be used if desired in cooperation with clamp lock plates 10 and clamp lever 11 to aid the ease of manipulation of clamp lever 11.

As illustrated in FIG. 1 of the drawing, drum lifting attachment 1 is equipped with collar lift straps 16 secured to drum collar 2, preferably by welding, and a lift ring 15 is preferably secured to collar lift straps 16 at the point of coincidence of the lift straps by means of lift ring bolt 6 and lift ring nut 7. It will be appreciated that alternative lifting fittings can be used in cooperation with collar lift straps 16 in order to make drum lifting attachment 1 compatible with a forklift truck or substantially any lifting device according to the knowledge of those skilled in the art. It will also be appreciated that a single collar lift strap 16, or more than two such lift straps may be utilized as desired, although a pair of lift straps disposed as illustrated in FIG. 1 of the drawing is preferred to enhance stability of the lifted drum during lifting and handling. Lift ring 15 is preferably mounted on collar lift straps 16 in such a manner as to permit the ring to swivel and rotate with respect to the lift straps in order to provide ready access to quick-release clamp 8 when it is desired to remove drum lifting attachment 1 from a drum.

Lifting of drum 14 after drum lifting attachment 1 is secured in position according to the procedure outlined above is achieved by attaching a chain or cable 5 to lift ring 15. In the alternative, the forks of a forklift truck or similar vehicle may be positioned under collar lift straps 16 to effect the desired handling. Where a chain or cable is used, it may be secured to an overhead hoist or fork truck, as desired, in order to move the drum to a new location. In the case of overhead hoists equipped with a lift hook, the lift hook can simply be engaged with lift ring 15, the hoist activated, and the drum lifted and handled.

The drum lifting attachment of this invention is characterized by convenience and utility in that it is capable of being quickly and easily strapped to a drum while the drum remains in an upright position. The drum can be subsequently lifted and handled while in the upright position without the necessity of using forklift vehicles equipped with cumbersome hook devices to approach the drum, engage a special attaching mechanism, orient the drum in carrying position (usually horizontal) and finally move the drum. The drum lifting attachment permits safe and secure handling since the drum is handled in an upright position securely gripped by a metal band which cannot deform or rupture the drum, and thereby avoids the problem of spillage and drum damage due to insecure fastenings; furthermore, the device has no pointed hooks or flanges characterized by prior art lifting devices. The lifting attachment can be used on substantially any drum, including open-top and bung-equipped drums which are equipped with a top rim. The device can also be adapted for use with drums not having a top rim by providing longer collar lift straps and securing the drum collar below the first drum stiffener located approximately one-fourth of the length of the distance down from the top of the drum.

Accordingly, having described my invention with the particularity set forth above, what is claimed is:

1. A drum lifting attachment comprising:

a. a drum collar shaped to substantially encircle a drum and having a first flange means and a second flange means fitted to the ends thereof, respectively;

b. a clamp lever having one end pivotally carried by said first flange means of said drum collar and the other end free, and a pair of clamp lock plates disposed in essentially parallel relationship, each of said clamp lock plates having one end pivotally carried by said second flange means of said drum collar and the othe end pivoted to said clamp lever;

c. two lift straps attached to said drum collar and spanning a diameter of said drum collar, and disposed at essentially a 90° angle with respect to each other and coinciding at the approximate center of and above the circle defined by said drum collar; and d. a lift ring pivotally secured to said lift straps at the coincidence of said lift straps.

2. The drum lifting attachment of claim 1 further comprising a lock pin removably carried by said lock plates and said clamp lever to secure said clamp lever in locked configuration.

* * * * *